United States Patent [19]

Flam et al.

[11] Patent Number: 4,932,387

[45] Date of Patent: Jun. 12, 1990

[54] EMERGENCY IGNITION SYSTEM FOR MOTOR VEHICLES

[76] Inventors: Doron Flam, Shazar Street 21/12, Kiryat Yam 29000; Hanoch Greenberg, Schviel Hagefen 5/3, Kiryat-Motzkin 26398, both of Israel

[21] Appl. No.: 292,172

[22] Filed: Dec. 30, 1988

[30] Foreign Application Priority Data

Jun. 30, 1988 [IL] Israel ..... 86939

[51] Int. Cl.[5] ..... F02P 3/01

[52] U.S. Cl. ..... 123/607; 123/641; 123/179 BG; 123/497

[58] Field of Search ..... 123/606, 607, 637, 640, 123/641, 498, 497, 179 BG, 179 G

[56] References Cited

U.S. PATENT DOCUMENTS

| | | | |
|---|---|---|---|
| 4,091,787 | 5/1978 | Frank | 123/606 |
| 4,096,830 | 6/1978 | Long | 123/179 G |
| 4,228,778 | 10/1980 | Rabus et al. | 123/640 |
| 4,328,771 | 5/1982 | Kawai et al. | 123/637 |
| 4,359,998 | 11/1982 | Topic | 123/606 |
| 4,528,972 | 7/1985 | de Beaumont et al. | 123/640 |
| 4,577,604 | 3/1986 | Hara et al. | 123/497 |

*Primary Examiner*—Tony M. Argenbright
*Assistant Examiner*—Robert Mates
*Attorney, Agent, or Firm*—Benjamin J. Barish

[57] ABSTRACT

An emergency ignition system for motor vehicles comprises a high-voltage coil having an input circuit connectible to the vehicle battery and an output circuit connectible to the vehicle distributor for applying high-voltage pulses. The input circuit includes an oscillator generating periodic pulses, and a switch controlled by the oscillator for periodically interrupting the input circuit to the coil and thereby causing the coil to generate high-voltage pulses to be applied to the vehicle distributor. The input circuit further includes a control circuit connectible to the vehicle battery and comprising a voltage-drop sensor for sensing a predetermined voltage drop at the output of the vehicle battery caused by the load thereon when starting the engine, and for producing an enabling signal in response to the predetermined voltage drop to enable the oscillator to output pulses to the switch for periodically interrupting the input circuit to the coil.

19 Claims, 3 Drawing Sheets

EMERGENCY IGNITION SYSTEM FOR MOTOR VEHICLES

BACKGROUND OF THE INVENTION

The present invention relates to an emergency ignition system for motor vehicles, and particularly to such a system for providing an alternative source of high-voltage pulses to the vehicle distributor in the event of a failure of the vehicle ignition system itself to provide such pulses.

The failure of a motor vehicle to start is frequently due to a malfunction in the ignition system of the vehicle preventing it from supplying the necessary high-voltage pulses to the distributor, which pulses are distributed by the distributor to the spark plugs in the cylinders of the vehicle engine. It has been proposed to provide, for use in such cases, an emergency ignition system, which includes a high-voltage coil having an input circuit connectible to the vehicle battery and an output circuit connectible to the vehicle distributor for supplying the high-voltage pulses thereto. In one known system, the input circuit to the high-voltage coil includes an oscillator generating periodic pulses, and a switch (e.g., a power transistor switch) controlled by the oscillator for periodically interrupting the input circuit to the coil and thereby causing the coil to generate high-voltage pulses to be applied to the vehicle distributor. In this known system, the oscillator is directly connected to the vehicle battery through a manual on/off switch, such that the oscillator immediately begins to oscillate upon closing the manual switch.

BRIEF SUMMARY OF THE INVENTION

An object of the present invention is to provide an improved emergency ignition system of the foregoing type for motor vehicles having advantages in a number of respects from the above known system as will be described more particularly below.

According to the present invention, there is provided an emergency ignition system of the foregoing type, characterized in that the input circuit further includes a control circuit connectible to the vehicle battery and comprising a voltage-drop sensor for sensing a predetermined voltage drop at the output of the vehicle battery caused by the load thereon when starting the engine, and for producing an enabling signal in response to the predetermined voltage drop to enable the oscillator to output pulses to the switch for periodically interrupting the input circuit to the coil.

According to a further important feature in the preferred embodiment of the invention described below, the control circuit also includes a time delay circuit connected to the output of the voltage-drop sensor to delay the enabling signal from the voltage-drop sensor for a few seconds sufficient to permit the battery voltage to recover, and the vehicle engine to start to turn over, before enabling the oscillator to generate the periodic pulses to the switch.

In the preferred embodiment of the invention described below, the control circuit further includes a bi-stable device having a first stable state disabling the oscillator, and a second stable state enabling the oscillator. The system further includes means responsive to connecting the system to the voltage battery for actuating the bi-stable device to its first state disabling the oscillator, and means responsive to the enabling signal from the voltage-drop sensor for actuating the bi-stable device to its second state enabling the oscillator. More particularly, in this described embodiment, the bi-stable device is a flip-flop which is reset when in its first state and set when in its second state, the output of the flip-flop being connected to one input of a logic gate having a second input from the voltage-drop sensor such that the logic gate is effective to enable the oscillator when the flip-flop is set or when the enabling signal is received from the voltage-drop sensor.

It will thus be seen that the emergency ignition system of the present invention may be connected in a simple manner to the normal vehicle ignition system by connecting the input circuit to the vehicle battery and the output circuit to the vehicle distributor. However, the emergency ignition system does not start to generate the high-voltage pulses to the distributor until the operator turns-on the ignition system, e.g., by the usual ignition key, since the voltage-drop sensor of the emergency ignition system must first sense a predetermined voltage drop at the output of the vehicle battery, caused by the load on the voltage battery when starting the engine, before producing the "enabling signal" to enable the oscillator to output pulses to the switch for periodically interrupting the input circuit to the coil. This reduces the possibility of a person accidentally being shocked by the high-voltage pulses outputted by the emergency ignition system, e.g., when handling the output cable while connecting it to the vehicle distributor. This arrangements also prevents wasting power from the vehicle battery in producing these high-voltage pulses until the vehicle starter is energized by the vehicle battery to turn-over the engine.

In addition, the provision of the delay circuit for delaying the enabling signal from the voltage-drop sensor to the oscillator for a few seconds, permits the battery to recover after starting, and also permits the vehicle engine to start to turn over, before the oscillator is enabled to generate the periodic pulses applied via the switch to the high-voltage coil.

The foregoing advantages are also applicable to a conventional ignition system, and therefore according to another aspect of the present invention, there is provided an ignition system for a motor vehicle engine comprising: a vehicle battery; a starter energized by the battery for starting the engine; a high-voltage coil connected to the battery for generating high-voltage pulses to be supplied to the engine; and a time delay circuit for delaying the generation of the high-voltage pulses by the high-voltage coil for a predetermined time period after the starter is operated to start the engine.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
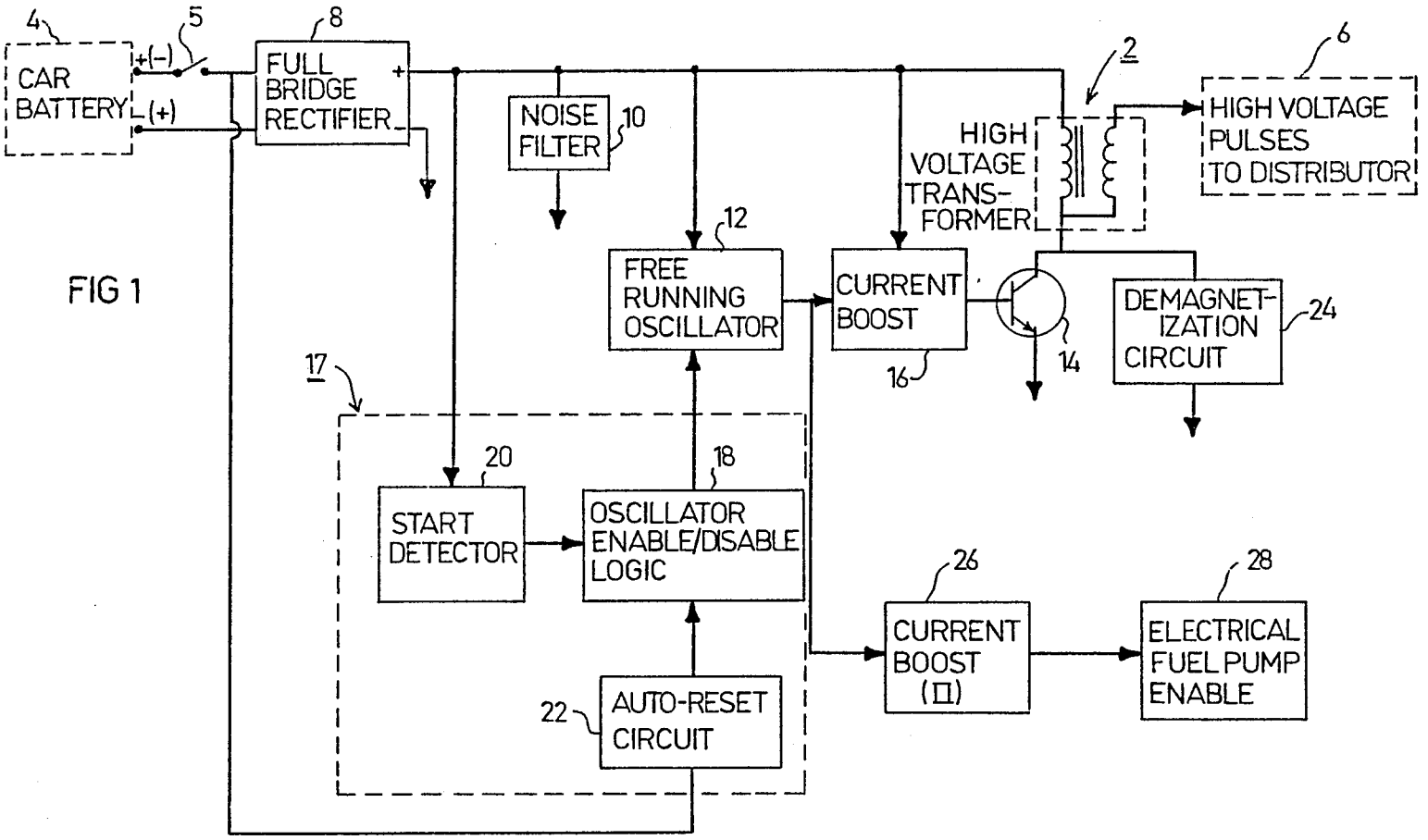
FIG. 1 is a block diagram illustrating one form of emergency ignition system constructed in accordance with the present invention.
Figure 2:
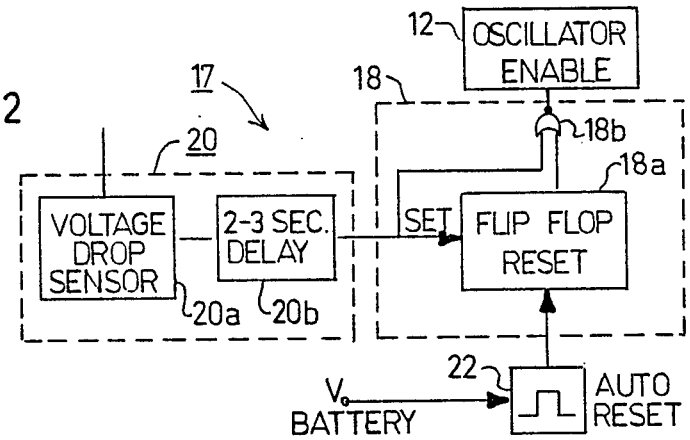
FIG. 2 is a block diagram of the oscillator enable/disable logic circuit included in the ignition system of FIG. 1.

The System of FIGS. 1 and 2

The ignition system illustrated in FIG. 1 of the drawings is intended to be used as an emergency ignition system to be connected between the vehicle battery and the vehicle distributor for supplying high-voltage pulses to the vehicle distributor in the event of a malfunction in the normal ignition system of the vehicle preventing the normal ignition system from supplying such high-voltage pulses to the distributor. The system illustrated in FIG. 1 is particularly for use with a motor vehicle having an electric fuel pump, since the system also supplies periodic pulses for the electric fuel pump.

More particularly, the emergency ignition system illustrated in FIG. 1 comprises a high-voltage coil, generally designated 2, having an input circuit at one side of the coil connectible to the vehicle battery (shown in broken lines at 4) and controlled by a manual switch 5, and an output circuit at the other side of the coil connectible to the vehicle distributor (shown in broken lines at 6) for supplying high-voltage pulses to the distributor. As known in vehicle ignition systems of this type, the distributor 6 distributes the high-voltage pulses to the spark plugs located in the cylinders of the vehicle engine for igniting the fuel within the cylinders to produce the power for driving the vehicle.

The input circuit to one side of coil 2 includes a full-wave rectifier bridge 8 which outputs a voltage of the proper polarity to coil 2 irrespective of the polarity of the connections to the vehicle battery 4. A noise filter 10 filters out the noise generated from the system.

The input circuit to coil 2 further includes a free-running oscillator 12 generating periodic pulses, and an electronic switch 14 controlled by the oscillator via a current-boost driver circuit 16, for periodically interrupting the input circuit to coil 2, thereby causing the coil to generate the high-voltage pulses to be applied to the vehicle distributor 6. Oscillator 12 is controlled by a control circuit 17, which includes an oscillator enable/-disable logic circuit 18, a start detector circuit 20, and an automatic-reset circuit 22. Control circuit 17 produces an "enabling signal" under certain predetermined conditions, to enable the oscillator to output pulses to electronic switch 14 for periodically interrupting the input circuit to the coil 2.

FIG. 2 more particularly illustrates control circuit 17 producing the enabling signal for enabling the oscillator 12. Thus, the start detector 20 in control circuit 17 includes a voltage-drop sensor 20*a* which is connected to the plus-terminal of the full-wave bridge rectifier 8 to sense the voltage at that terminal. More particularly, voltage-drop sensor 20*a* senses a predetermined voltage drop at the output of the battery caused by the load on the battery when starting the vehicle engine. Thus, assuming the vehicle includes a twelve-volt battery, when the emergency ignition system is first connected to the vehicle battery, the twelve-volts of the battery will be applied to voltage sensor 20*a*, but the sensor will not yet produce an enabling signal. However, when the operator turns on the vehicle ignition switch to start the starter, the load of the starter applied to the vehicle battery will cause the voltage of the vehicle battery to drop about 1–3 volts. This drop in the voltage produced when the vehicle battery is loaded by the engine starter will be sensed by the voltage- drop sensor 20*a*, which sensor will produce an "enabling signal" at its output.

Start detector 20 further includes a time delay circuit 20*b* which delays this "enabling signal" produced by the voltage-drop sensor for a period of about 2–3 seconds. The purpose of this delay is to permit the vehicle battery to recover its full voltage, and the vehicle engine to start to turn over, before the enabling signal actually enables the oscillator 12 to output the periodic pulses to the electronic switch 14 for periodically interrupting the coil 2, and for causing the coil to generate the high-voltage pulses applied to the distributor 6.

The oscillator enable disable logic circuit 18 includes a bi-stable device in the form of a flip-flop 18*a* and a NOR-gate 18*b*. Gate 18*b* has one input connected to receive the enabling signal from circuit 20 (after the two-three second delay by its delay circuit 20*b*), and a second input connected to the output terminal of flip-flop 18*a*.

The automatic reset circuit 22 is a circuit which outputs a signal to reset flip-flop 18*a* when circuit 22 is connected to the voltage battery, namely to the plus terminal of the full-wave bridge rectifier 8. The flip-flop is actuated to its set condition by the enabling signal from circuit 20.

When flip-flop 18*a* is in its "reset" state, it outputs a signal via NOR-gate 18*b* which disables oscillator 12; and when in its "set" state, it outputs a signal via gate 18*b* which enables oscillator 12 to output its periodic pulses. Oscillator 12 is also enabled by the enabling signal generated in the voltage-drop sensor 20*a*, after being delayed the two-three seconds by delay circuit 20*b*.

It will be seen that the emergency ignition system illustrated in FIGS. 1 and 2, insofar as described above, is used and operates in the following manner:

When the normal ignition system of the vehicle fails to produce the necessary high-voltage pulses to be applied to the distributor, the emergency ignition system illustrated in FIGS. 1 and 2 would be used, by connecting the input terminals of the full-wave bridge rectifier 8 to the vehicle battery 4, and connecting the output of the coil 2 to the vehicle distributor 6. As soon as the first connection is made, the automatic reset circuit 22 resets flip-flop 18*a*, whereby the output signal applied by the flip-flop via NOR-gate 18*b* disables oscillator 12, so that the oscillator does not yet generate periodic signals to be applied via electronic switch 14 to the coil 2. Thus, no-voltage pulses are yet produced by the coil to the distributor.

The operator then turns on the ignition switch to energize the engine starter. This loads the vehicle battery 4 such that its normal voltage, e.g., 12 volts, drops somewhat because of this load. This drop in voltage from the car battery is sensed by sensor 20*a*, which, in response to the sensed voltage drop, produces an enabling signal. This enabling signal is delayed two-three seconds by delay circuit 20b, before being applied both to the NOR-gate 18b and to the flip-flop 18a. As soon as this delayed enabling signal is applied via gate 18b to the oscillator 12, it enables the oscillator to generate periodic pulses which are applied via the current-boost driver circuit 16 to the base of power transistor 14, thereby periodically interrupting the voltage supply to coil 2. This causes the coil to generate the high-voltage pulses applied to the distributor 6.

The delayed enabling signal applied via gate 18b to oscillator 12 is also applied to flip-flop 18a to set the flip-flop, so that, as soon as this enabling signal is terminated by the recovery of the vehicle battery to its normal voltage, the flip-flop 18a will now continue to apply the enabling signal via gate 18b to oscillator 12 to maintain the oscillator energized, and thereby to maintain the supply of the high-voltage pulses by coil 2 to the distributor 6.

Whenever the supply of such pulses is no longer necessary, manual switch 5 is opened, thereby disconnecting the battery supply to the input circuit of the coil 2.

Flip-flop 18a, if still in its set condition, is immediately reset as soon as the automatic reset circuit 22 is again connected to the vehicle battery, so that the oscillator 12 will not start again to generate its periodic pulses until the vehicle starter is again energized, as sensed by the voltage-drop sensor 20a.

The system illustrated in FIG. 1 further includes a demagnetization circuit 24 connected between the power transistor 14 and the coil 2 for dissipating the energy stored in coil 2. The illustrated circuit further includes a current-booster driver circuit 26 connected to the output of oscillator 12 for boosting and outputting the periodic signals generated by the oscillator to the electric fuel pump 28 of the motor vehicle.

The System of FIGS. 3–6

Figure 3:
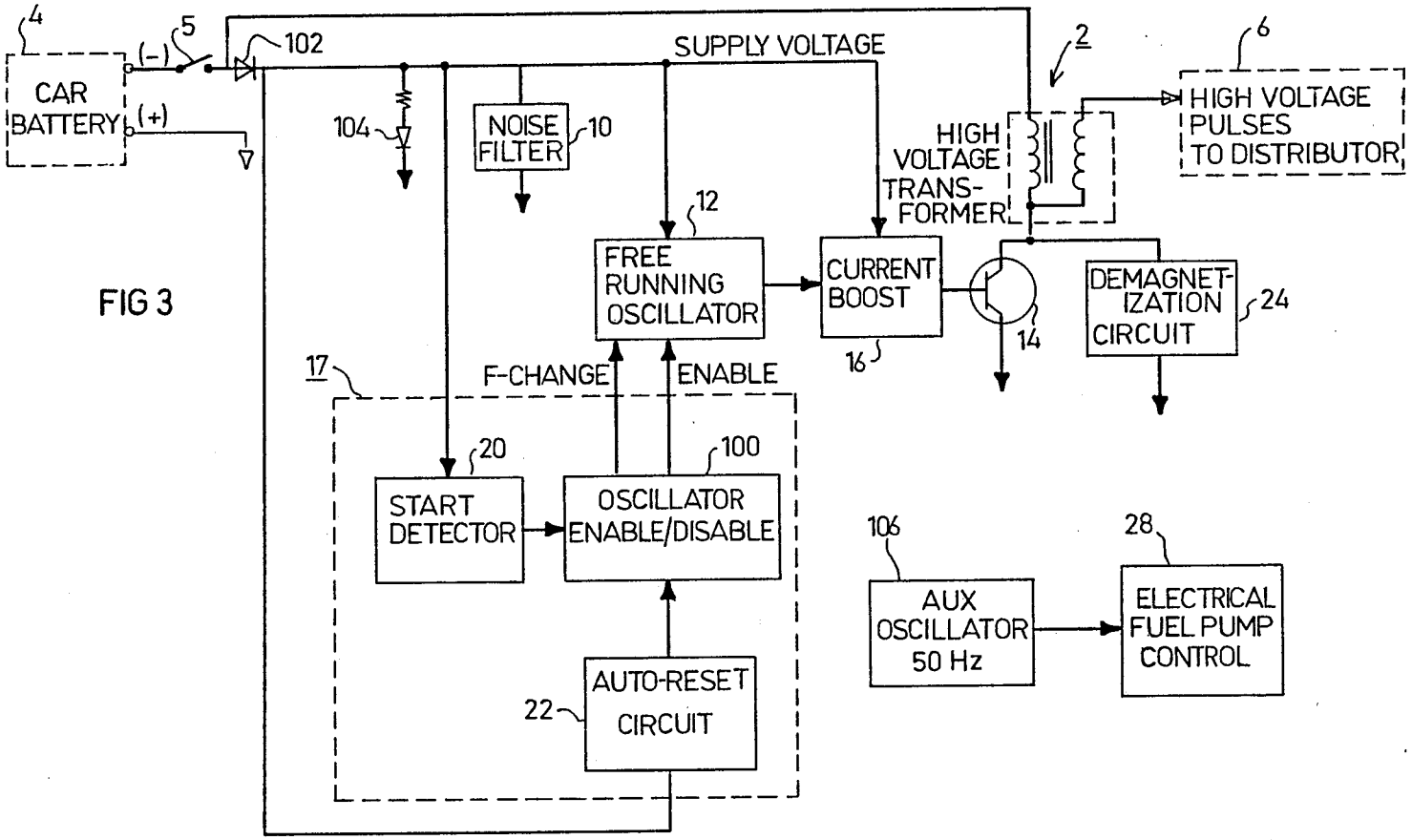
FIG. 3 is a block diagram illustrating another form of emergency ignition system constructed in accordance with the present invention.

FIG. 3 illustrates an ignition system similar to that of FIG. 1 but including a number of modifications. To facilitate understanding the system of FIG. 3, those elements which are generally in common with the elements in FIG. 1 are identified by the same reference numerals as in FIG. 1, whereas the new or substantially modified elements are identified by reference numerals beginning with "100".

Thus, a main change in the system of FIG. 3, as compared to that of FIG. 1, is in the construction of the oscillator enable/disable logic circuit, identified as 18 in FIG. 1 and as 100 in FIG. 3. Logic circuit 100 in the system of FIG. 3 is also controlled by the start detector 20 and the auto-reset circuit 22, as in the system of FIG. 1, but in addition to outputting an enabling signal to the free-running oscillator 12, it also outputs a frequency-changes signal to the oscillator.

Figure 4:
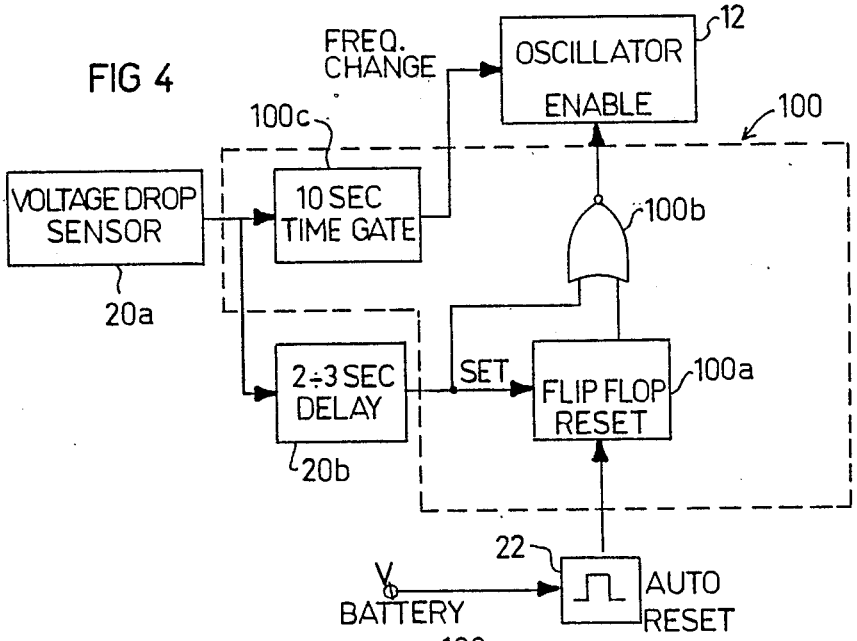
FIG. 4 is a block diagram of the oscillator enable/disable logic circuit included in the ignition system of FIG. 3.

Logic circuit 100 in the system of FIG. 3 is more particularly illustrated in FIG. 4. It includes, in addition to the flip-flop circuit 100a and gate 100b, corresponding to circuit 18a and 18b in FIG. 2, also a ten-second time delay circuit 100c. Flip-flop circuit 100a and gate 100b operate in the same manner as described above with respect to the system of FIGS. 1 and 2 to output an "enabling" signal to the oscillator 12 after the elapse of 2–3 seconds, as controlled by delay circuit 20b, following the sensing of a voltage-drop by the sensor 20a in the start detector circuit 20, as described above with respect to FIGS. 1 and 2. Such an "enabling" signal applied to osciallator 12 causes the oscillator to output pulses at a predetermined frequency and having a predetermined "on time", which pulses are applied via the current boost circuit 16 to the switching transistor 14 to periodically interrupt the high voltage coil of transformer 2, as described above.

When ten seconds have elapsed after the oscillator has thus been enabled, the time-delay circuit 100c applies a signal to the oscillator 12 to cause the oscillator to increase the frequency of its output pulses and to decrease the "on time" of the output pulses. Such an arrangement thus decreases the frequency of interruption of the high-voltage coil in transformer 2, and increases its "on time", thereby enabling the coil to supply more power to the distributor 6 of the engine when staring the engine.

Particularly good results have been obtained when oscillator 12 first operates at a frequency of 200 Hz with an "off time" of 3.8 ms and an "off time" of 1.2 ms, and after the lapse of ten seconds, operates at a frequency of 320 Hz with an "on time" of 1.9 ms and an "off time" of 1.2 ms. The time delay circuit 20b introduces a time delay of 1–4 seconds, preferably 2–3 seconds; and the time-delay circuit 100c introduces a delay of 5–15 seconds, preferably about 10 seconds.

Another change in the systems illustrated in FIG. 3, over that illustrated in FIG. 1, is the omission of the full-bridge rectifier 8. Instead, the system of FIG. 3 includes a diode 102 and an LED (light-emitting diode) 104 to indicate the polarity.

A still further change in the system of FIG. 3, over that of FIG. 1, is that the electric fuel pump control circuit 28 is controlled by an auxiliary oscillator 106, rather than by the main oscillator 12 supplying the pulses for interrupting the high-voltage coil.

Figure 5:
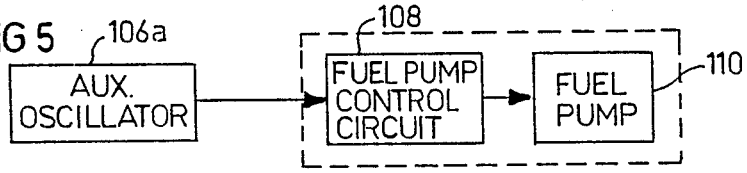
FIG. 5 is a block diagram illustrating the connection of the auxilary oscillator in the system of FIG. 3 to a fuel pump control circuit in motor vehicles equipped with conventional electric fuel pumps, i.e. not controlled by a computer.
Figure 6:
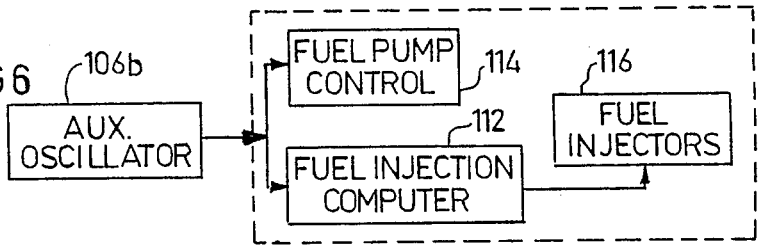
FIG. 6 is a block diagram illustrating the connection of the auxilary oscillator in the system of FIG. 3 to a fuel pump control circuit in motor vehicles equipped with a computer-controlled fuel injection system.

FIGS. 5 and 6 illustrate two arrangements that may be used, according to the motor vehicle in which the system is installed. Thus, FIG. 5 illustrates the arrangement wherein the auxilary oscillator, therein designated 106a, is directly connected to the fuel pump control circuit 108 for controlling the fuel pump 110 in a motor vehicle having a conventional electric fuel pump without a computer; whereas FIG. 6 illustrates the arrangement wherein the auxilary oscillator, therein designated 106b, is connected to output its pulses both to the fuel injection computer 112 and to the fuel pump control 114 in motor vehicles having a computer-controlled fuel injection system. In both cases, the auxilary oscillator 106a, 106b operates at a lower frequency than the main oscillator 12.

While the invention has been described with respect to two preferred embodiments, it will be appreciated that many other variations, modifications and applications of the invention may be made.

What is claimed is:

1. An emergency ignition system for motor vehicles, comprising a high-voltage coil having an input circuit connectible to the vehicle battery, and an output circuit connectible to the vehicle distributor for supplying high-voltage pulses thereto; said input circuit including an oscillator generating periodic pulses, and a switch controlled by said oscillator for periodically interrupting the input circuit to the coil and thereby causing the coil to generate high-voltage pulses to be applied to the vehicle distributor; said input circuit further including a control circuit connectible to the vehicle battery and comprising a voltage-drop sensor for sensing a predetermined voltage drop at the output of the vehicle battery caused by the load thereon when starting the engine, and for producing an enabling signal in response to said predetermined voltage drop to enable said oscillator to output pulses to said switch for periodically interrupting the input circuit to the coil.

2. The system according to claim 1, wherein said control circuit also includes a time delay circuit connected to the output of said voltage-drop sensor to delay said enabling signal from the voltage-drop sensor for a few seconds sufficient to permit the battery voltage to recover, and the vehicle engine to start to turn over, before enabling the oscillator to generate the periodic pulses to the switch.

3. The system according to claim 1, wherein said control circuit further includes; a bi-stable device having a first stable state disabling the oscillator, and a second stable state enabling the oscillator; means responsive to connecting the system to the voltage battery for actuating said bi-stable device to its first state disabling the oscillator; and means responsive to said enabling signal from the voltage-drop sensor for actuating said bi-stable device to its second state enabling the oscillator.

4. The system according to claim 3, wherein said bi-stable device is a flip-flop which is reset when in its first state and set when in its second state, the output of the flip-flop being connected to one input of a logic gate having a second input from said voltage-drop sensor such that said logic gate is effective to enable said oscillator when the flip-flop is set or when the enabling signal is received from the voltage-drop sensor.

5. The system according to claim 1, wherein said switch is a power transistor, and said control circuit includes a current-boost driver circuit between the output of said oscillator and the control element of said power transistor.

6. The system according to claim 5, further including a demagnetizing circuit between the output of said power transistor and the input to said high-voltage coil.

7. The system according to claim 5, for use with a motor vehicle having an electrical fuel pump, said system further including a second current-boost driver circuit controlled by said oscillator for supplying periodic pulses to said electric fuel pump.

8. The system according to claim 1, wherein said input circuit of the high-voltage coil further includes a full-wave rectifier circuit outputting a voltage of the proper polarity to the coil irrespective of the polarity of the connections of the input circuit to the vehicle battery.

9. The system according to claim 1, wherein said input circuit further includes a noise filter for filtering out noise generated from the system.

10. The system according to claim 1, wherein said control circuit includes frequency-change means effective, upon the elapse of a predetermined time period after the oscillator starts to output pulses to said switch, to increase the frequency of the pulses outputted by said oscillator and to decrease the "on time" of said pulses.

11. The system according to claim 10, wherein said oscillator, when enabled by said enabling signal from the control circuit, first outputs pulses at a frequency of about 200 Hz and having an "on time" of aabout 3.8 ms, and then, upon the elapse of said predetermined time period, outputs pulses at a frequency of about 320 Hz and having an "on time" of about 1.9 ms.

12. The system according to claim 10, wherein said predetermined time interval is 5–15 seconds.

13. The system according to claim 10, wherein said control circuit also includes a time delay circuit connected to the output of said voltage-drop sensor to delay said enabling signal from the voltage-drop sensor for a few seconds sufficient to permit the battery voltage to recover, and the vehicle engine to start to turn over, before enabling the oscillator to generate the periodic pulses to the switch.

14. The system according to claim 13, wherein said time delay circuit delays said enabling signal for 1–4 seconds.

15. The system according to claim 10, for use with a motor vehicle having an electric fuel pump, said system further including a second oscillator for supplying periodic pulses to said electric fuel pump.

16. An ignition system for a motor vehicle engine, comprising: a vehicle battery; a starter energized by the battery for starting the engine; a high-voltage coil connected to said battery for generally high-voltage pulses to be supplied to the engine; a control circuit connectable to the vehicle battery and comprising a voltage-drop sensor for sensing a predetermined voltage drop at the output of the vehicle battery caused by the load thereon when starting the engine; and a time delay circuit effective to delay the generation of the high-voltage pulses by the high-voltage coil for a predetermined time period after said sensor senses said predetermined voltage drop.

17. The system according to claim 16, wherein said predetermined time period is 1–4 seconds.

18. The system according to claim 16, further including an oscillator generating periodic pulses, and a switch controlled by said oscillator for periodically interrupting said high-voltage coil for generating said high-voltage pulses; said control circuit being effective to output an enabling signal to enable said oscillator to generate said periodic pulses only upon the elapse of said predetermined time period after the starter has been operated to start the engine.

19. The system according to claim 18, wherein said control circuit further includes a bi-stable device having a first stable state disabling the oscillator, and a second stable state enabling the oscillator; means responsive to connecting the system to the voltage battery for actuating said bi-stable device to its first state disabling the oscillator; and means responsive to said enabling signal from said control circuit for actuating said bi-stable device to its second state enabling the oscillator.

* * * * *

UNITED STATES PATENT AND TRADEMARK OFFICE

CERTIFICATE OF CORRECTION

PATENT NO. : 4,932,387

DATED : June 12, 1990

INVENTOR(S) : Doron Flamm et al.

It is certified that error appears in the above-identified patent and that said Letters Patent is hereby corrected as shown below:

Column 6, Line 18, "off time" (first occurrence) should be --on time--.

Column 8 Line 28, "generally" should be --generating--.

Signed and Sealed this

Fourth Day of January, 1994

Bruce Lehman

*Attest:*

BRUCE LEHMAN

*Attesting Officer*

*Commissioner of Patents and Trademarks*